US007484723B2

(12) United States Patent
Kuo et al.

(10) Patent No.: US 7,484,723 B2
(45) Date of Patent: Feb. 3, 2009

(54) SEPARATION ROLLER SET OF AN AUTOMATIC DOCUMENT FEEDER (ADF)

(75) Inventors: Ping-Hung Kuo, Taipei (TW); Jung-Mao Tiao, Si Chih (TW)

(73) Assignee: Qisda Corporation, Taoyuan County (TW)

( * ) Notice: Subject to any disclaimer, the term of this patent is extended or adjusted under 35 U.S.C. 154(b) by 330 days.

(21) Appl. No.: 11/519,997

(22) Filed: Sep. 12, 2006

(65) Prior Publication Data

US 2007/0063422 A1 Mar. 22, 2007

(30) Foreign Application Priority Data

Sep. 13, 2005 (TW) ..... 94131548 A

(51) Int. Cl.
*B65H 5/00* (2006.01)

(52) U.S. Cl. ..... 271/10.09; 271/114; 271/121; 271/242

(58) Field of Classification Search ..... 271/10.09, 271/109, 114, 121, 242
See application file for complete search history.

(56) References Cited

U.S. PATENT DOCUMENTS

| | | | | |
|---|---|---|---|---|
| 4,667,244 | A * | 5/1987 | Ishikawa | 358/498 |
| 5,423,526 | A * | 6/1995 | Hasegawa | 271/10.13 |
| 5,435,539 | A * | 7/1995 | Namiki | 271/114 |
| 2004/0051230 | A1* | 3/2004 | Tanaka et al. | 271/121 |
| 2006/0151936 | A1* | 7/2006 | Brown et al. | 271/10.01 |

* cited by examiner

*Primary Examiner*—David H Bollinger

(57) ABSTRACT

A separation roller set comprises a shaft, a separation roller, a separation pad, an aligning roller, and an idle roller is provided in the present invention. The separation roller is fixed on the shaft with the separation pad leaning thereon. The separation roller is utilized to carry a sheet of paper moving through a gap between the separation roller and the separation pad. The aligning roller is located on the shaft with an idle roller leaning thereon. The leading edge of the sheet of paper leaving the gap is stopped and aligned by the aligning roller and the idle roller.

20 Claims, 6 Drawing Sheets

SEPARATION ROLLER SET OF AN AUTOMATIC DOCUMENT FEEDER (ADF)

BACKGROUND OF THE INVENTION (1) Field of the Invention

This invention relates to a separation roller set of an automatic document feeder (ADF), and more particularly relates to a separation roller set enabling feeding alignment.

(2) Description of the Prior Art

For early computer users, a scanner was a novel peripheral product and was mainly used by professional digital image operating users due to complex operating procedure. However, attending with the progressing of digital image technology, cheap and user's friendly scanners are available in the market and have become an indispensable part for personal users or small size offices.

Scanners at present may be briefly classified into feeder type and flatbed type. The flatbed type scanner has a design similar to a small-sized copier, which is characterized by placing papers, books, or documents on a glass plate to be scanned. Due to the advantages of small size and low cost, flatbed type scanner is more popular among self-employers. Nowadays, with the progress of scanning technologies, even the scanning of three-dimensional objects has become feasible for flatbed-type scanners.

In contrast with flatbed-type scanners, feeder-type scanners are mainly used in the environment of a large amount of sheet of papers to be scanned. A major advantage of feeder-type scanners is the so-called multi-page continuously scanning function, which leads to a relatively high scanning speed. However, due to the multi-page continuously scanning design, feeder-type scanners cannot be used to scan stapled documents, photographs, or three-dimensional objects.

FIG. 1 shows a sheet feeder 10 of a typical automatic document feeder (ADF) to facilitate multi-page scanning, which includes a pickup roller 12, a pickup arm 14, a separation roller 16, and a separation pad 18. The pickup arm 14 is pivotally connected to a shaft 16*a* of the separation roller 16. The pickup roller 12 is assembled to a movable end of the pickup arm 14. The separation pad 18 is a fixed element and can be divided into a feeding portion 18*b* and a separation portion 18*a*. There is a gap between the separation portion 18*a* and the separation roller 16 with the dimension ranged between the thickness of single sheet of paper and two sheet of papers.

As the sheet of paper S is fed, the movable end of the pickup arm 14 is declined along direction Y so as to have the pickup roller 12 attaching the sheet of paper S. The sheet of papers S are then driven by the pickup roller 12 along direction Z. The movement of the sheet of papers S is blocked by the separation pad 18 and the separation roller 16, and only the uppermost sheet of paper S can be carried through the gap between the separation portion 18*a* of the separation pad 18 and the separation roller 16 into the ADF.

However, the sheet feeder 10 cannot facilitate any aligning feature. In detail, the sheet of paper with some aligning error cannot be adjusted by the separation pad 18 to have the leading edge thereof parallel to the shaft of the separation roller 16.

Accordingly, it has become an important issue in the development of sheet feeder to prevent the problems of feeding misalignment and multiple feed.

SUMMARY OF THE INVENTION

It is a main object of the present invention to enable feeding alignment, which is performed by aligning the leading edge of the sheet of paper to the shaft of the separation roller.

A separation roller set provided in the present invention comprises a shaft, a separation roller, a separation pad, an aligning roller, and an idle roller. The separation roller is fixed on the shaft with the separation pad leaning thereon. The separation roller is utilized to carry a sheet of paper moving through a gap between the separation roller and the separation pad. The aligning roller is disposed on the shaft with an idle roller leaning thereon. The leading edge of the sheet of paper leaving the gap is stopped and aligned by the aligning roller and the idle roller.

An automatic document feeder (ADF) is also provided in the present invention. The ADF comprises a paper tray, a separation roller set, a midway roller set, and an exit roller set. The paper tray is utilized for placing sheet of papers. The separation roller set is located downstream of the paper tray. The midway roller set is located downstream of the separation roller set to carry the sheet of paper leaving the separation roller set to a scanning or printing position. The exit roller set is located downstream of the midway roller set to carry the sheet of paper leaving the scanning or printing position and to output the sheet of paper from the ADF.

The separation roller set of the ADF comprises a shaft, a separation roller, a separation pad, an aligning roller, and an idle roller. The separation roller is fixed on the shaft with the separation pad leaning thereon. The separation roller is utilized to carry a sheet of paper moving through a gap between the separation roller and the separation pad. The aligning roller is disposed on the shaft with an idle roller leaning thereon. The leading edge of the sheet of paper leaving the gap is stopped and aligned by the aligning roller and the idle roller.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
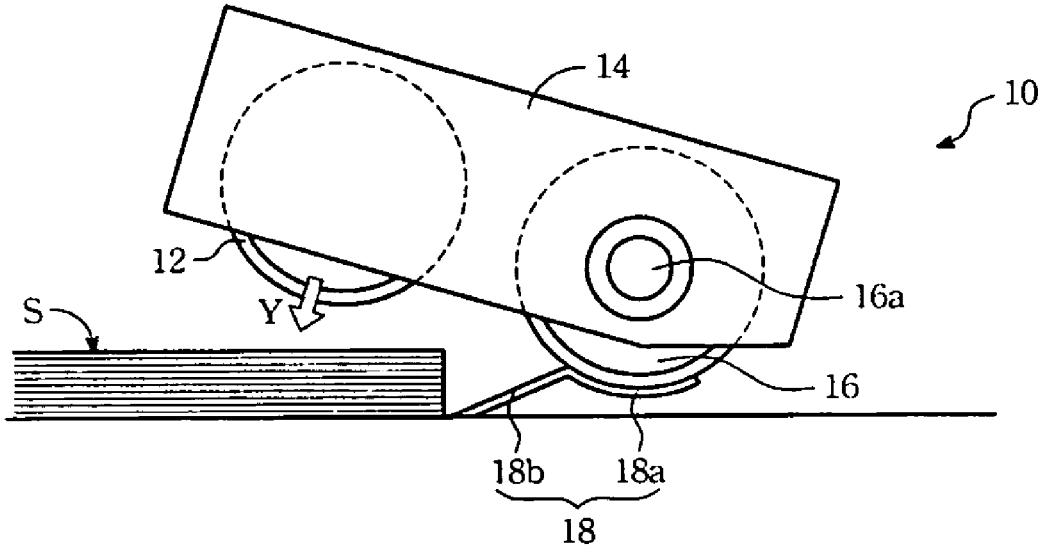
FIG. 1 (Prior Art)
FIG. 1 is a schematic view of the sheet feeder of a typical automatic document feeder (ADF)
Figure 2A:
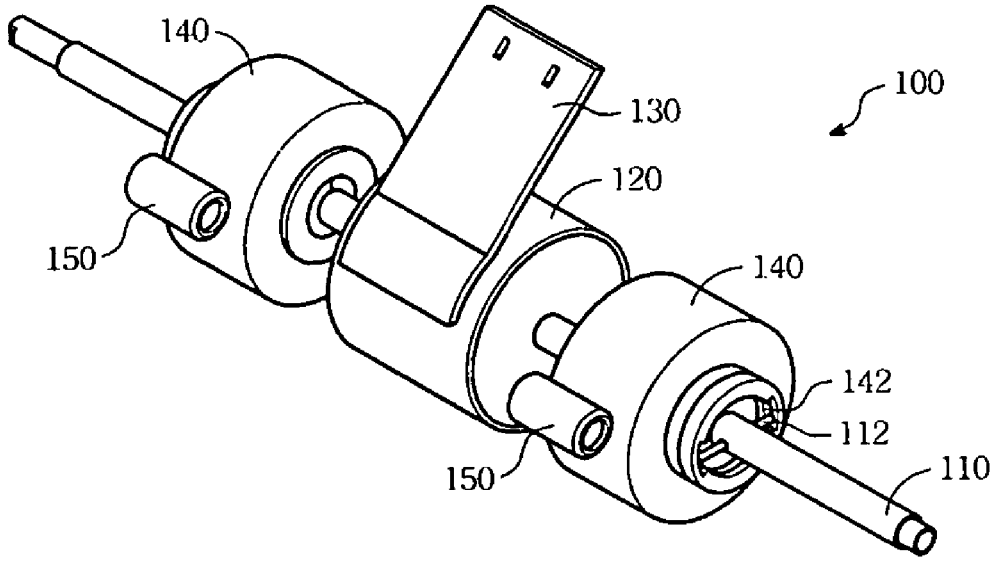
FIG. 2A is a schematic view depicting a preferred embodiment of the separation roller set in accordance with the present invention.

FIG. 2A shows a preferred embodiment of the separation roller set 100 in accordance with the present invention. The separation roller set 100 has a shaft 110, a separation roller 120, a separation pad 130, two aligning rollers 140, and two idle rollers 150 with respect to the aligning rollers 140. The separation roller 120 is fixed on the shaft 110. The separation pad 130 leans on the separation roller 120. The separation roller 120 is utilized to carry a sheet of paper moving through a gap between the separation roller 120 and the separation pad 130. The two aligning rollers 140 are disposed but not fixed on the shaft 110.

It is noted that the two aligning rollers 140 are located on the opposite sides with respect to the separation roller 120. Both the two aligning rollers 140 has a respective idle roller 150 leaning thereon. The present embodiment uses two aligning rollers 140 to access a preferred feeding alignment, whereas, the usage with only one aligning roller may perform an qualified promotion of feeding alignment in some cases.

Figure 2B:
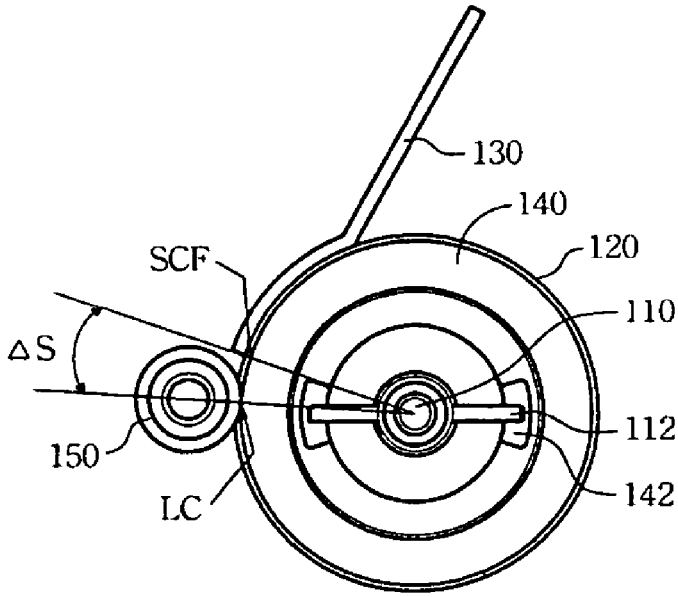
FIG. 2B is a side view of the separation roller set shown in FIG. 2A along the direction of the shaft.

Also referring to FIG. 2B, which shows a side view of the separation roller set 100 in FIG. 2A along the direction of the shaft 110, the aligning roller 140 has a diameter a little smaller than that of the separation roller 120, and the idle roller 150 has a diameter smaller than that of the aligning roller 140. It is noted that the idle roller 150 and the aligning roller 140 form a line contact LC therebetween leading a front edge SCF of a surface contact between the separation pad 130 and the separation roller 120 with a predetermined angle ΔS along the rotational direction of the shaft 110. That is, the line contact LC is downstream of where the separation pad 130 and the separation roller 120 make contact. In addition, each of the two aligning rollers 140 has two trenches 142. The shaft 110 has two pins 112 located on opposite sides thereof extending into the two trenches 142 respectively for driving the aligning rollers 140.

It is noted that the number and the shape of the pins 112 for driving the aligning rollers 140 may not be a limitation, and even the shaft with single pin is applicable in the present invention. As a preferred embodiment, in case with multiple pins being used, the distribution of the pins 112 had better being axial symmetrical with respect to the shaft 110, and the trenches 142 for locating the pins must have identical distribution.

Figure 3A:
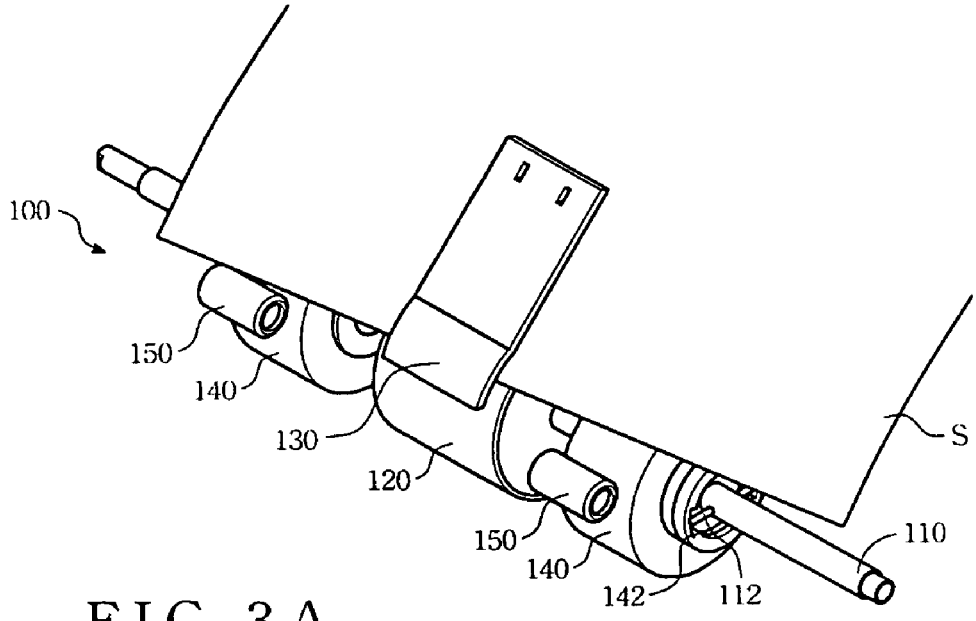
FIGS. 3A and B are schematic views depicting the feeding aligning process by using the separation roller set in accordance with the present invention.
Figure 3B:
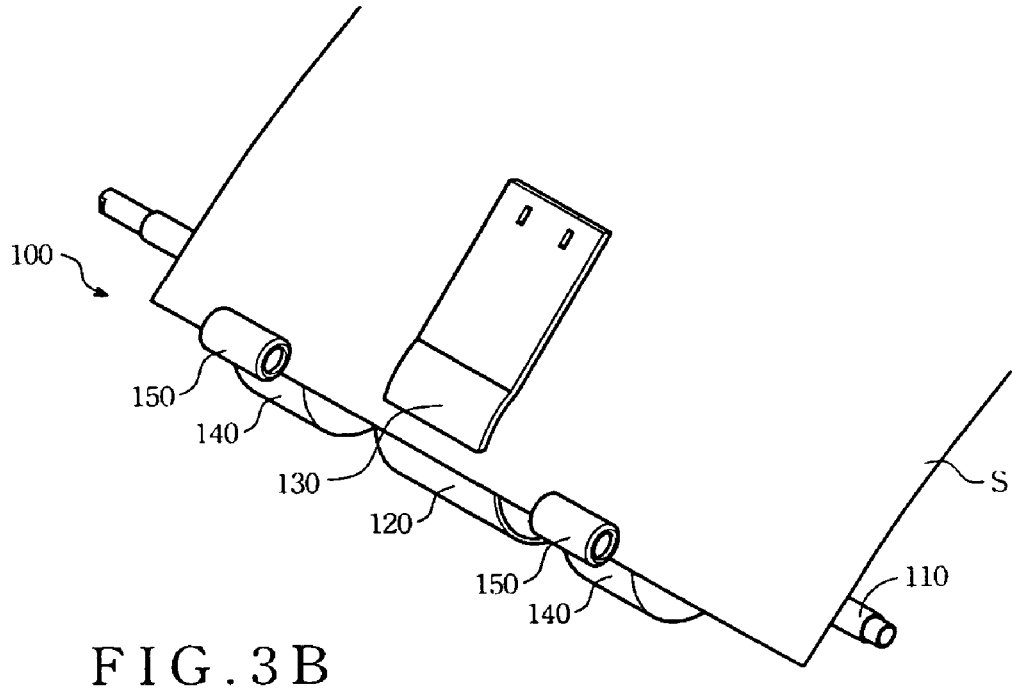

FIGS. 3A and B shows the feeding aligning process by using the separation roller set 100 in accordance with the present invention. As shown in FIG. 3A, the sheet of paper S being loaded is carried forward by the separation roller 120. The leading edge of the sheet of paper S is stopped by the idle roller 150 and the aligning roller 140, after leaving the gap between the separation pad 130 and the separation roller 120. Meanwhile, the continuous rotation of the separation roller 120 driving the sheet of paper S forward to force the leading edge of the sheet of paper S aligning to the shaft 110 of the aligning roller 140 to enable feeding alignment.

Figure 4A:
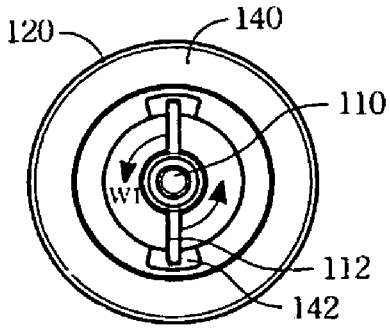
FIGS. 4A to E depict the operation of the shaft and the aligning roller in the feeding aligning process of FIGS. 3A and B.
Figure 4B:
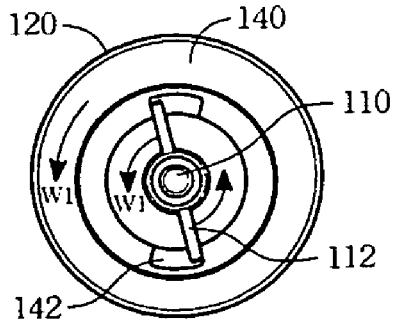

FIGS. 4A to E depict the feeding aligning process shown in FIGS. 3A and B in view of the shaft 110 and the aligning roller 140. As shown in FIGS. 4A and B, after the sheet of paper S being stopped by the aligning roller 140 and the idle roller 150 (not shown in the figures), the shaft (with an angular speed of w1) keeps on rotating with a predetermined time to make sure the leading edge of the sheet of paper S aligning to the shaft 110 of the aligning roller 140. Meanwhile, the rotation of the shaft has the pin 112 attach a leading edge of the respective trench 142 to engage with the trench 142 to drive the aligning roller 140. It is noted that the aligning roller 140 driven by the pins 112 has an angular speed identical to the angular speed w1 of the shaft 110. In addition, the rotation of the aligning roller 140 enables the sheet of paper S, which was stopped by the aligning roller 140 and the idle roller 150, to be carried through the gap between the idle roller 150 and the aligning roller 140.

Figure 4C:
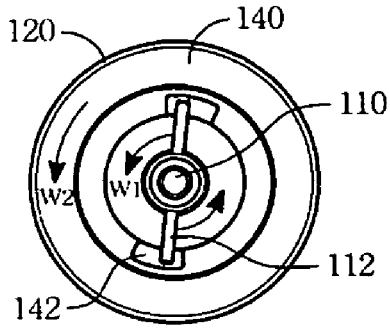

In addition, while the sheet of paper S driven by the separation roller 120 is carried through the gap between the idle roller 150 and the aligning roller 140, the sheet of paper S drives the aligning roller 140 by surface friction. Thus, the linear speed on the surface of the separation roller 120 is identical to the proceeding speed of the sheet of paper S, which is identical to that on the surface of the aligning roller 140. Since the diameter of the aligning roller 140 is smaller than that of the separation roller 120, as shown in FIG. 4C, the angular speed of the aligning roller 140 must be greater than the angular speed of the separation roller 120. In addition, since the angular speed of the separation roller 120 fixed o the shaft 110 is identical to the angular speed of the shaft 110, as shown in FIG. 4C, the pins 112 on the shaft 110 are disengaged with the trench 142 and moves from the leading edge of the trench 142 toward the rear edge of the trench 142.

Figure 4D:
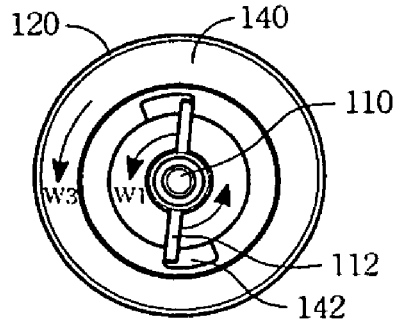
Figure 4E:
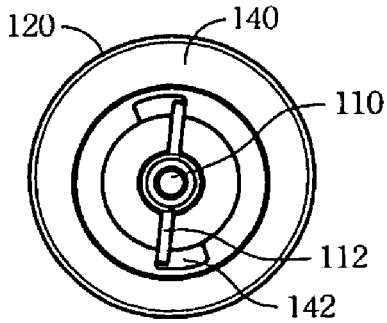

Referring to FIG. 4D, as the pin 112 attaches the rear edge of the trench 142 to engaged with the trench 142, the angular speed of the aligning roller 140 is forced to be identical to the angular speed of the separation roller 120. Due to the different diameters of the separation roller 120 and the aligning roller 140, the linear speed on the surface of the aligning roller 140 becomes smaller than that on the surface of the separation roller 120, which results a tensile force to over-drag the sheet of paper S.

Figure 5A:
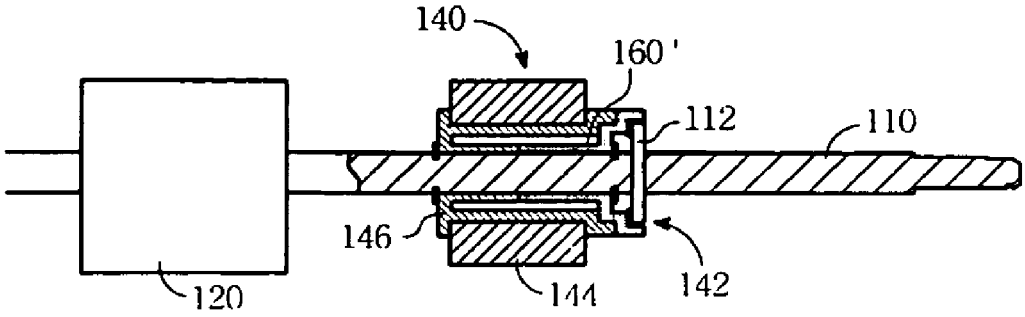
FIG. 5A is a cross-section view depicting a preferred embodiment of the aligning roller of the separation roller set in accordance with the present invention.

In order to prevent the tensile force, referring to FIG. 5A, as a preferred embodiment, the aligning roller 140 of the separation roller set is composed of a body 144, a sleeve 146, and an one-way clutch 160'. The body 144 is fixed on the sleeve 146. The sleeve 146 is assembled but not fixed on the shaft 110 so that the body 144 of the aligning roller 140 is able to rotate with respect to the shaft 110.

In addition, the pin 112 on the shaft 110 is utilized to drive the aligning roller 140 through the one-way clutch 160' located on the inner surface of the body 144. The one-way clutch 160' is characterized with one-way rotational limitation to ensure the aligning roller 140 rotating only in one direction. Thus, also referring to FIG. 4D, as the pin 112 attaches the rear edge of the trench 142 to lower down the angular speed of the aligning roller 140, the one-way clutch 160' acts as a bearing to make sure that the body 144 of the aligning roller 140 maintains the original angular speed to prevent the tensile force.

Figure 5B:
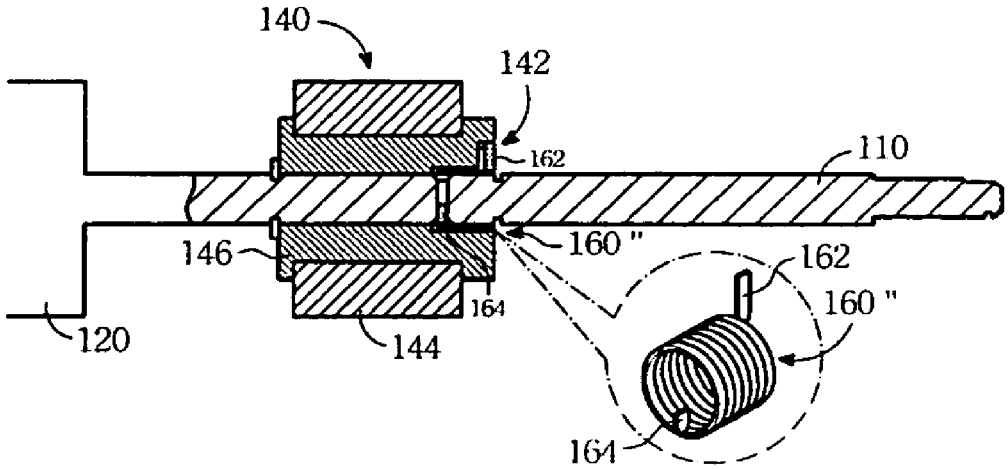
FIG. 5B is a cross-section view depicting another preferred embodiment of the aligning roller of the separation roller set in accordance with the present invention.

FIG. 5B shows another preferred embodiment of the aligning roller 140 in accordance with the present invention. In compared with embodiment of FIG. 5A, the present embodiment uses a different one-way clutch 160" to replace the function of the pins on the shaft 110. As shown, the one-way clutch 160" may be a metal coil with both ends 162 and 164 inserted into the hole on the shaft 110 and the trench 142 on the aligning roller 140 respectively. Since it is more tolerable for the metal coil 160" to be extended than compressed, as the rotation of the shaft 110 tends to compress the metal coil 160", the aligning roller 140 is effectively driven by the shaft 110. Whereas, as the rotation of the shaft 110 tends to extend the metal coil 160", the aligning roller 140 may not be effectively driven by the shaft 110.

Figure 6:
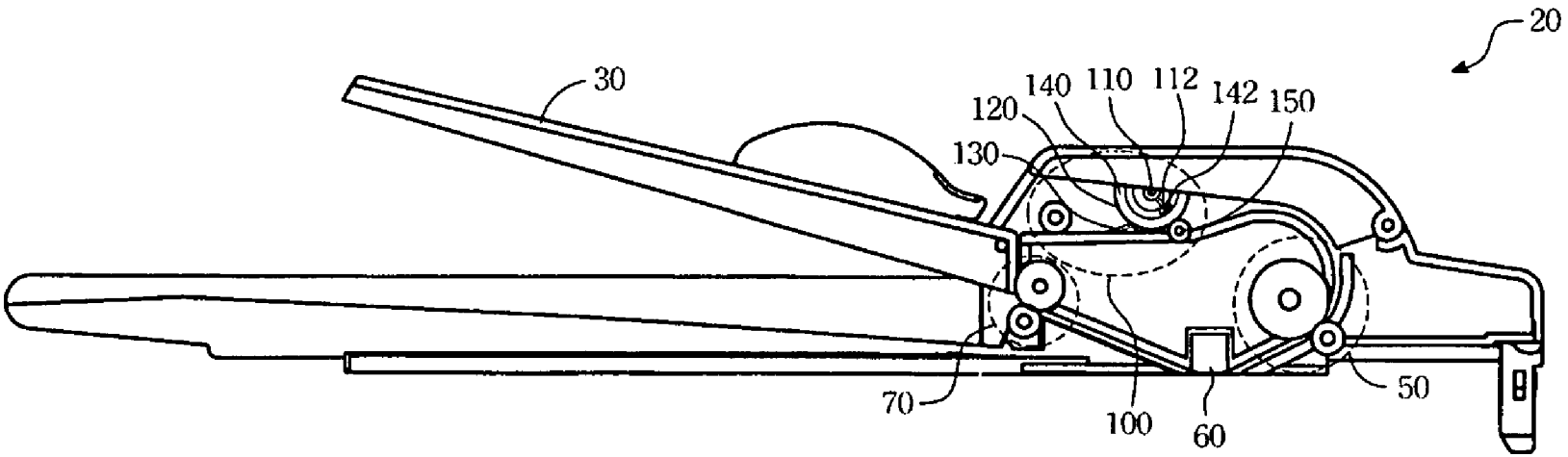
FIG. 6 is a schematic view depicting a preferred embodiment of the separation roller set applied in the ADF in accordance with the present invention.

FIG. 6 shows a preferred embodiment of an automatic document feeder (ADF) 20 in accordance with the present invention. The ADF 20 has a paper tray 30, a separation roller set 100, a midway roller set 50, and an exit roller set 70. The paper tray 30 is utilized for placing sheet of papers S. The separation roller set 100 is located downstream of the paper tray 30 to load the sheet of papers S by piece. The midway roller set 50 is located downstream of the separation roller set 100 to carry the sheet of paper S leaving the separation roller set 100 to a scanning or printing position 60. The exit roller set 70 is located downstream of the midway roller set 50 to carry the sheet of paper S leaving the scanning or printing position 60 and to output the sheet of paper S from the ADF 20.

The separation roller set 100 has a shaft 110, a separation roller 120, a separation pad 130, at least an aligning roller 140, and at least an idle roller 150. The separation roller 120 is fixed on the shaft 110 with the separation pad 130 leaning thereon. The separation roller 120 is utilized to carry the sheet of paper S moving through a gap between the separation roller 120 and the separation pad 130. The aligning roller 140 is disposed on the shaft 110 with an idle roller 150 leaning thereon. The leading edge of the sheet of paper S is stopped and aligned by the aligning roller 140 and the idle roller 150 after leaving the gap between the separation roller 120 and the separation pad 130.

The separation roller set 100 in accordance with the present invention does not need an additional power source solely for driving the aligning roller 140. Instead, the aligning roller 140 is driven by the pins 112 on the shaft 110. Meanwhile, the trench 142 on the aligning roller 140 in cooperation with the pins 112 on the shaft 110 achieves the object of feeding alignment. Moreover, the usage of one-way clutch 160', 160" prevents the tensile force applied on the sheet of paper due to the linear speed difference on the surfaces of the aligning roller 140 and the separation roller 120. In conclusion, the separation roller set 100 in the present invention has a distinct promotion, which not only save the cost of the additional power source but also reduce the probability of mechanical breakdown.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

We claim:

1. A separation roller set comprising:

a shaft;

a separation roller fixed on the shaft;

a separation pad, leaning on the separation roller, which is used to carry a sheet of paper moving through a gap between the separation roller and the separation pad;

a first aligning roller, disposed on the shaft; and an idle roller, leaning on the first aligning roller;

wherein a leading edge of the sheet of paper leaving the gap is stopped and aligned by the first aligning roller and the idle roller.

2. The separation roller set of claim 1, wherein the first aligning roller has a diameter smaller than that of the separation roller.

3. The separation roller set of claim 1, wherein a line contact of the idle roller and the first aligning roller is downstream of where the separation pad and the separation roller make contact.

4. The separation roller set of claim 1, wherein the first aligning roller has at least a trench, the shaft has at least a pin extending into the trench; wherein as the sheet of paper is stopped by the first aligning roller and the idle roller, the shaft keeps on rotating to have the pin engage the trench to drive the first aligning roller to carry the sheet of paper through a gap between the idle roller and the first aligning roller.

5. The separation roller set of claim 4, wherein the shaft has two pins on the opposite sides thereof, and the first aligning roller has two trenches corresponding to the two pins.

6. The separation roller set of claim 4, wherein as the sheet of paper is carried through the gap between the idle roller and the first aligning roller, the sheet of paper drives the first aligning roller to disengage the pin with the trench.

7. The separation roller set of claim 6, further comprising an one-way clutch assembled in the first aligning roller to ensure the first aligning roller rotating only in one direction.

8. The separation roller set of claim 1, further comprising a second aligning roller located on the opposite side of the first aligning roller with respect to the separation roller, and each of the two aligning rollers has a respective idle roller.

9. The separation roller set of claim 1, wherein the first aligning roller is fixed on a sleeve assembled on the shaft.

10. The separation roller set of claim 1, wherein the idle roller has a diameter smaller than that of the first aligning roller.

11. An automatic document feeder (ADF) comprising:

a paper tray for placing a sheet of paper;

a separation roller set located downstream of the paper tray comprising:

a shaft;

a separation roller fixed on the shaft;

a separation pad, leaning on the separation roller, which is used to carry the paper moving thorough a gap between the separation roller and the separation pad;

a first aligning roller, disposed on the shaft; and a idle roller, leaning on the first aligning roller;

wherein as the paper leaving the separation pad, a leading edge of the paper is stopped and aligned by the first aligning roller and the idle roller;

a midway roller set, located downstream of the separation roller set, for carrying the paper leaving the separation roller set to a scanning or printing position; and an exit roller set, located downstream of the midway roller set, for carrying the paper leaving the scanning or printing position and for outputting the paper from the ADF.

12. The ADF of claim 11, wherein the first aligning roller has a diameter smaller than that of the separation roller.

13. The ADF of claim 11, wherein a line contact of the idle roller and the first aligning roller is downstream of where the separation pad and the separation roller make contact.

14. The ADF of claim 11, wherein the first aligning roller has at least a trench, the shaft has at least a pin extending into the trench; wherein as the paper is stopped by the first aligning roller and the idle roller, the shaft keeps on rotating to have the pin engage the trench to drive the first aligning roller to carry the paper through a gap between the idle roller and the first aligning roller.

15. The ADF of claim 14, wherein the shaft has two pins on the opposite sides thereof, and the first aligning roller has two trenches corresponding to the two pins.

16. The ADF of claim 14, wherein as the paper is carried through the gap between the idle roller and the first aligning roller, the paper drives the first aligning roller to disengage the pin with the trench.

17. The ADF of claim 16, further comprising an one-way clutch assembled in the first aligning roller to ensure the first aligning roller rotating only in one direction.

18. The ADF of claim 11, further comprising a second aligning roller located on the opposite side of the first aligning roller with respect to the separation roller, and each of the two aligning rollers has a respective idle roller.

19. The ADF of claim 11, wherein the first aligning roller is fixed on a sleeve assembled on the shaft.

20. The ADF of claim 11, wherein the idle roller has a diameter smaller than that of the first aligning roller.

* * * * *